US009103352B2

(12) United States Patent
Sadi et al.

(10) Patent No.: US 9,103,352 B2
(45) Date of Patent: Aug. 11, 2015

(54) VENTILATOR

(75) Inventors: Omar Sadi, Hessental (DE); Andreas Gross, Neuenstein (DE); Lothar Ernemann, Heilbronn (DE); Frieder Lörcher, Braunsbach (DE)

(73) Assignee: Ziehl-Abegg AG, Künzelsau (DE)

( * ) Notice: Subject to any disclaimer, the term of this patent is extended or adjusted under 35 U.S.C. 154(b) by 184 days.

(21) Appl. No.: 13/208,367

(22) Filed: Aug. 12, 2011

(65) Prior Publication Data

US 2012/0039731 A1 Feb. 16, 2012

(30) Foreign Application Priority Data

Aug. 12, 2010 (DE) ..... 10 2010 034 036
Apr. 1, 2011 (DE) ..... 10 2011 015 784

(51) Int. Cl.
*F04D 29/54* (2006.01)
*F04D 29/16* (2006.01)
(Continued)

(52) U.S. Cl.
CPC ..... *F04D 29/542* (2013.01); *F04D 25/0613* (2013.01); *F04D 29/164* (2013.01); *F04D 29/703* (2013.01)

(58) Field of Classification Search
CPC ..... F04D 25/02; F04D 25/06; F04D 25/0606; F04D 25/0613; F04D 25/08; F04D 25/12; F04D 19/002; F04D 29/542; F04D 29/164; F04D 29/703; H02K 9/06
USPC ..... 417/423.1, 423.7, 423.9, 423.14, 417/423.15, 352, 353, 355, 356; 415/121.2, 415/191, 199.4, 200; 416/191, 23; 310/62–63, 67 R
See application file for complete search history.

(56) References Cited

U.S. PATENT DOCUMENTS 4,406,581 A * 9/1983 Robb et al. ..... 415/173.5
6,776,578 B2 * 8/2004 Belady ..... 415/221
(Continued)

FOREIGN PATENT DOCUMENTS

EP 1 895 166 A1 3/2008
WO 2004/094835 A1 11/2004

OTHER PUBLICATIONS

Bakir F. et al: Experimental Aeroacoustic Analysis of Efficient Automotive Engine Cooling Fan Systems;Fan Noise 2003; International Symposium Senlis Sep. 23-25, 2003 (cited in specification, p. 1, 3rd paragraph).

*Primary Examiner* — Charles Freay
*Assistant Examiner* — Lilya Pekarskaya
(74) *Attorney, Agent, or Firm* — Gudrun E. Huckett

(57) ABSTRACT

A ventilator for use in air-conditioning and refrigeration technology has a housing of plastic material in a one-part configuration having integrally formed therein an inlet nozzle, cylinder-shaped flow guiding means, outlet guide vanes, and a diffusor. A drive motor is arranged in the housing. An impeller wheel is rotatably supported about a central axis in the housing and driven by the drive motor. A protective screen is connected to the housing. A motor support is connected by the outlet guide vanes to the housing. The impeller wheel has vanes with radially outwardly positioned vane ends, wherein the vane ends are embodied as flow elements (winglets). The flow elements are spaced at a minimal spacing relative to a sidewall of the housing. The drive motor is an external rotor motor that is embodied either as an alternating current asynchronous motor (AC) or an electronically commutated direct current motor (EC).

14 Claims, 3 Drawing Sheets

(51) Int. Cl.
*F04D 25/06* (2006.01)
*F04D 29/70* (2006.01)

(56) References Cited

U.S. PATENT DOCUMENTS 7,132,772 B2 * 11/2006 Takeuchi et al. ..... 310/88
7,326,032 B2 * 2/2008 Vinson et al. ..... 415/173.1
7,438,522 B2 10/2008 Eimer
7,611,403 B2 * 11/2009 Wenger ..... 454/338
7,726,939 B2 * 6/2010 Lee et al. ..... 415/211.2
7,812,488 B2 * 10/2010 Cosco et al. ..... 310/68 E
8,313,282 B1 * 11/2012 Jarrah et al. ..... 415/62
2004/0104628 A1 * 6/2004 Streng et al. ..... 310/51
2005/0186096 A1 8/2005 Vinson et al.
2006/0045736 A1 * 3/2006 Lee et al. ..... 415/220
2006/0210397 A1 9/2006 Eimer
2007/0071603 A1 3/2007 Takeuchi et al.
2007/0286724 A1 12/2007 Takemoto et al.
2008/0219836 A1 * 9/2008 Decker et al. ..... 415/177
2009/0226312 A1 * 9/2009 Liu et al. ..... 415/211.2
2010/0247316 A1 * 9/2010 Aynsley et al. ..... 416/189

* cited by examiner

VENTILATOR

BACKGROUND OF THE INVENTION

The invention concerns a ventilator comprised of a one-part housing of plastic material with the integrated elements inlet nozzle, cylindrical flow guiding means, diffusor, outlet guide vanes, and a motor support connected thereto; an impeller wheel that is supported so as to rotate about a central axis and that is comprised of a central hub and vanes connected thereto with flow elements (winglets) at the radial outer ends; an electric drive motor that is embodied as external rotor motor either in AC or EC technology; as well as a protective screen that can be connected to an appropriate device of the housing provided for this purpose.

WO 2004/094835 A1 discloses a ventilator with a ventilator conveying passage and an impeller wheel arranged therein that is rotatable about a central axis and has a central hub with an outer circumference on which ventilator vanes are attached that extend with their radial outer edges up to a surface that provides an outward boundary and that have crescent-shaped leading edges and that, in the area of the radial outer edge, are provided with flow elements that are designed as flow obstacles for a compensation flow flowing about this radial outer edge from the pressure side to the suction side.

In the Fan Noise article "Experimental Aeroacoustic Analysis of Efficient Automotive Engine Cooling Fan System", 2003, an energy-efficient ventilator for use in vehicle cooling systems is described that is comprised of an impeller wheel with motor mounted in a housing that integrates the functional elements cylindrical flow guiding means, diffusor, and outer guide vanes in one component, wherein the compact configuration of the ventilator is emphasized.

It is the object of the invention to provide a ventilator which, while having a compact configuration, provides further noise reduction as well as a higher degree of efficiency wherein a protective screen is also integrated into the inventive ventilator.

SUMMARY OF THE INVENTION

According to the invention this object is solved in that the ventilator, in particular for use in air-conditioning and refrigeration technology, comprised of a housing, an impeller wheel rotatably supported about a central axis, a drive motor, and a protective screen, is characterized in that in the housing that is comprised of plastic material in a one-part configuration, the flow elements inlet nozzle, cylinder-shaped flow guiding means, outlet guide vanes and diffusor are integrated, wherein the outlet guide vanes simultaneously provide for attachment of the motor connection to the outer contour, and a device is provided on the housing on which the protective screen, in particular a mesh screen, can be mounted, as well as in that the radially outwardly positioned vane ends of the vanes of the impeller wheel are embodied as special flow elements (winglets) which have an especially small spacing relative to the sidewall as well as in that the drive motor is an external rotor motor that is embodied either as alternating current asynchronous motor (AC) or an electronically commutated direct current motor (EC).

On the one hand, the housing of the ventilator that is comprised of plastic material in a one-part configuration integrates the elements that are decisive for the increase of the degree of efficiency, i.e., the inlet nozzle, cylinder-shaped flow guiding means, outlet guide vanes, and diffusor, in a compact component wherein the outlet guide vanes at the same time provide for connection of the motor support wherein the use of external rotor motors enables a particularly compact configuration.

On the other hand, in particular with respect to noise reduction, the object is solved according to the invention in that profiled vanes and outlet guide vanes are employed wherein the radial outer ends of the impeller wheel vanes are provided with flow elements (winglets) and wherein the head gap between vanes and cylinder-shaped flow guiding means is embodied to be particularly small which is made possible only by use of special plastic materials and injection molding techniques.

The housing carries out several functions simultaneously and requires in this connection comparatively minimal mounting space. For example, the housing provides the function of suspension of the complete impeller wheel with its electric drive motor that is designed as an external rotor motor. The transmission to the exterior of all forces and moments acting on the ventilator is realized by means of the outlet guide vanes connecting the motor support and the housing. These outlet guide vanes that reduce the circumferential component of the outflow speed contribute with their special profiling significantly to the increase of the static efficiency of the ventilator. In this connection, the inlet nozzle of the housing has the task of accelerating, substantially without loss, the fluid from the suction-side space and has for this purpose in flow direction a special narrowing contour.

In order to further minimize the losses and the noise generation that is caused by the gap between the vane tips of the impeller wheel and this sidewall of the cylinder-shaped flow guiding means, this gap is designed to be very small. Moreover, flow elements (winglets) provide for significantly reduced noise generation.

The flow passes downstream of the impeller wheel, deflected by the outlet guide vanes, into the diffusor, i.e., a substantially widening flow passage. By means of the diffusor in particular the axial component of the outflow speed is reduced; this leads to a further increase of the efficiency and thus of the performance of the ventilator. Moreover, on the housing at the outlet of the flow a protective screen can be attached that is embodied in particular as a mesh screen. A further aspect of the invention is that external rotor motors are used, either embodied in AC or EC technology. This enables a particularly compact configuration wherein the EC motors provide an additional efficiency advantage.

The outlet guide vanes are curved multi-dimensionally, wherein their leading edges preferably are crescent-shaped and their trailing edges are preferably serrated or of a wavy shape.

The crescent-shaped leading edge of the outlet guide vanes are preferably arranged slanted in a direction opposite to the rotational direction of the impeller wheel.

The housing has an uneven number of outlet guide vanes arranged on the motor support.

The housing with inlet nozzle, cylinder-shaped flow guiding means, outlet guide vanes, motor support, and diffusor is comprised of fiberglass-reinforced plastic material.

The impeller wheel comprises a hub on which several curved or twisted vanes are arranged.

The leading edges of the vanes are preferably concavely shaped and in rotational direction are arranged advancing in a crescent shape.

The trailing edges of the vanes are convex, serrated or of a wavy shape.

The hub of the impeller wheel in flow direction is embodied to widen conically.

In the housing, downstream of the motor support, a motor connection box is integrated.

The cover of the motor connection box is integrated monolithically on the protective screen.

The interface of the motor support can be varied by means of various shaping inserts in the injection mold for the housing, in particular in that alternatively the interface for an AC motor or EC motor can be selected.

The outer area of the inlet nozzle about its circumference has fastening devices, preferably in the form of openings.

The outer shape of the inlet nozzle is preferably round, square, or rectangular.

BRIEF DESCRIPTION OF THE DRAWINGS

The invention will be described with the aid of one embodiment in more detail.

DESCRIPTION OF PREFERRED EMBODIMENTS

Figure 1:
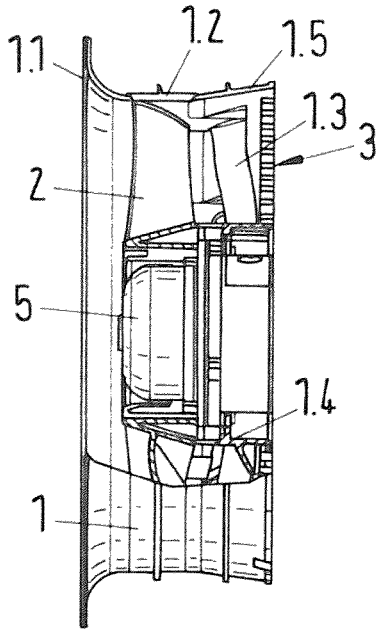
FIG. 1 shows a ventilator in longitudinal section.

FIG. 1 shows a ventilator, here an axial ventilator, in longitudinal section with its housing 1 that in flow direction has a specially designed tapering contour of the inlet nozzle 1.1 that is adjoined by a cylindrical flow guiding means 1.2 as well as a widening flow passage, a diffusor 1.5. At the most narrow location of the housing 1, the cylinder-shaped flow guiding means 1.2, the impeller wheel 2 is arranged whose vane tips that are embodied as special flow guiding elements (winglets) are spaced only at a minimal spacing relative to the cylinder-shaped flow guiding means 1.2 for minimization of the noise generation and of losses of the degree of efficiency. Downstream of the impeller wheel 2 the outlet guide vanes 1.3 that are fixedly connected to the housing 1 are arranged and are connected at the hub side to the motor support 1.4 on which the drive motor 5 together with the impeller wheel 2 are attached. At the end of the housing 1 a protective screen 3 is arranged that can be connected inside as well as outside of the diffusor 1.5.

Figure 2:
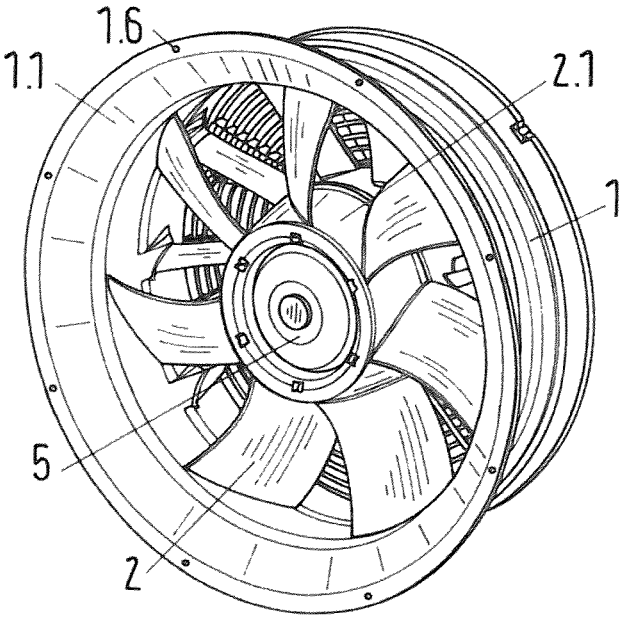
FIG. 2 shows the ventilator in perspective front view.

FIG. 2 shows the axial ventilator in a slanted view from the front in which in the housing 1 the spatial arrangement of the impeller wheel 2 with impeller wheel hub 2.1 and motor 5 is illustrated. Also illustrated are attachment devices 1.6 in the inlet nozzle 1.1, embodied here as bores.

Figure 3:
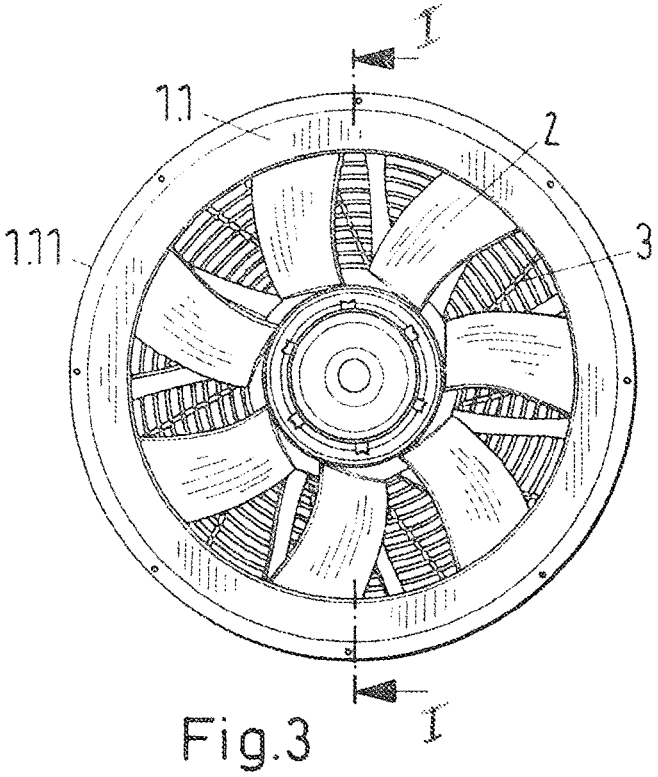
FIG. 3 shows the ventilator in plan view.

FIG. 3 shows the axial ventilator in a plan view with the inlet nozzle 1.1, impeller wheel 2 and protective screen 3. In this connection, the outer shape 1.11 of the inlet nozzle 1.1 not only can be round, as illustrated here, but can also have a square, rectangular or other shape.

Figure 4:
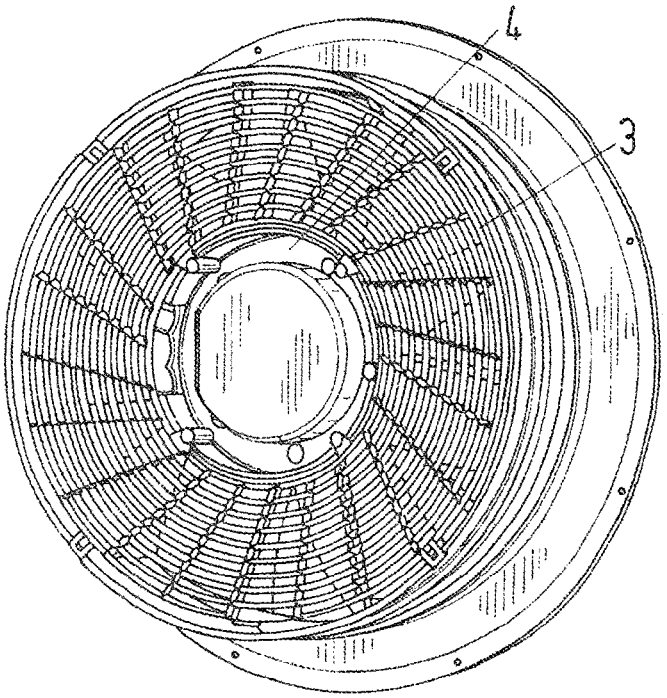
FIG. 4 shows the ventilator in perspective rear view.

In FIG. 4, the axial ventilator is illustrated in a slanted rear view with protective screen 3 and centrally arranged motor connection box 4. The motor connection box 4 can be attached on the protective screen 3 as well as on the motor support 1.4 in a detachable way.

Figure 5:
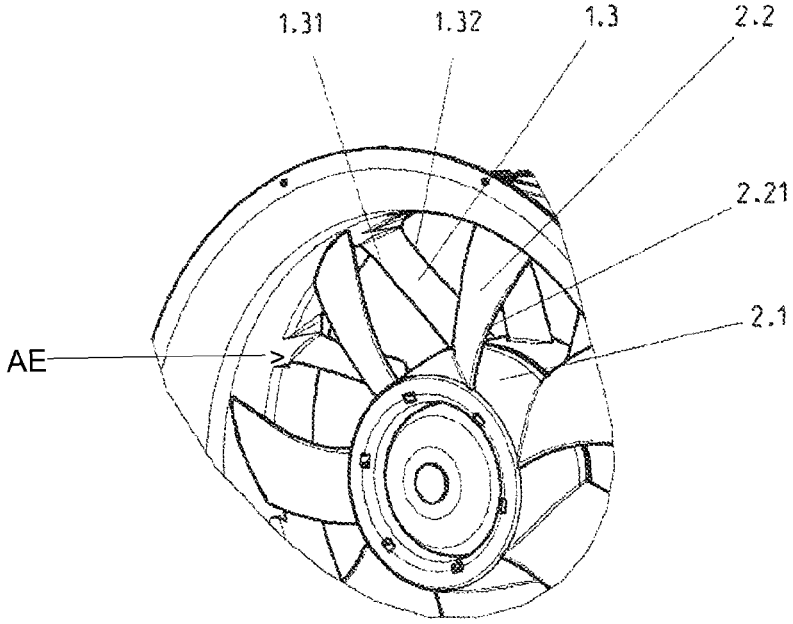
FIG. 5 shows a detail of the ventilator with impeller wheel and outlet guide vanes, the protective screen being removed.

FIG. 5 shows a section of the axial ventilator with impeller wheel and outlet guide vanes where the leading edges 2.21 of the curved or twisted vanes 2.2 on the impeller wheel hub 2.1 are preferably concavely shaped and in the rotational direction are arranged advancing in a crescent shape. Moreover, it is illustrated that the outlet guide vanes 1.3 are curved multi-dimensionally wherein their leading edges 1.31 are preferably crescent-shaped and their trailing edges 1.32 are preferably serrated or have a wavy shape. The cylinder-shaped flow guiding means 1.2 has extensions AE extending axially into the diffuser 1.5 to connection points of the outlet guide vanes 1.3.

Figure 6:
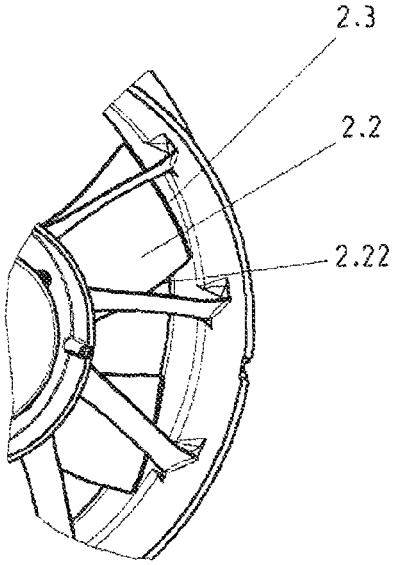
FIG. 6 shows a detail of the ventilator with vane contours, the protective screen being removed.

FIG. 6 shows furthermore a detail of the axial ventilator in which the trailing edges 2.22 of the vanes 2.2 can be convexly shaped and serrated or have a wavy shape and whose radial outer ends are formed as winglets 2.3. The vanes 2.2 that at the radial end are embodied as winglets 2.3 contribute to a substantial reduction of flow turbulences and thus to a significant noise reduction.

The specification incorporates by reference the entire disclosure of German priority document 10 2010 034 036.7 having a filing date of Aug. 12, 2010 and of German priority document 10 2011 015 784.0 having a filing date of Apr. 1, 2011.

While specific embodiments of the invention have been shown and described in detail to illustrate the inventive principles, it will be understood that the invention may be embodied otherwise without departing from such principles.

What is claimed is:

1. A ventilator for use in air-conditioning and refrigeration technology, the ventilator comprising:

a one-part plastic housing comprising an inlet nozzle, cylinder-shaped flow guiding means, outlet guide vanes, and a diffusor, wherein the inlet nozzle, the cylinder-shaped flow guiding means, the outlet guide vanes, and the diffusor are together monolithically formed of plastic material;

a drive motor arranged in the housing;

an impeller wheel rotatably supported about a central axis in the housing and driven by the drive motor, wherein the outlet guide vanes are arranged downstream of the impeller wheel;

a protective screen connected to the housing, wherein the protective screen is positioned downstream of the outlet guide vanes on the housing;

a motor support connected by the outlet guide vanes to the housing;

wherein the impeller wheel has vanes with radially outwardly positioned vane ends, wherein the vane ends are embodied as winglets;

wherein the winglets are spaced at a minimal spacing relative to a sidewall of the housing and said minimal spacing minimizes efficiency losses and noise development;

wherein the drive motor is an external rotor motor that is embodied either an as alternating current asynchronous motor (AC) or an electronically commutated direct current motor (EC);

wherein the outlet guide vanes are curved multi-dimensionally and each have a leading edge and a trailing edge;

wherein the leading edge is crescent-shaped and the trailing edge is serrated or has a wavy shape;

wherein the crescent-shaped leading edge is arranged in a direction opposite to a rotational direction of the impeller wheel.

2. The ventilator according to claim 1, wherein the housing has an uneven number of the outlet guide vanes.

3. The ventilator according to claim 1, wherein the housing together with the inlet nozzle, the cylinder-shaped flow guiding means, the outlet guide vanes, the motor support, and the diffusor is comprised of fiberglass-reinforced plastic material.

4. The ventilator according to claim 1, wherein the impeller wheel comprises a hub on which the vanes are arranged, wherein the vanes have a twisted or curved shape.

5. The ventilator according to claim 4, wherein the vanes each have a leading edge that is concavely shaped and in rotational direction is arranged advancing in a crescent shape.

6. The ventilator according to claim 4, wherein the vanes each have a trailing edge that is convex, serrated or of a wavy shape.

7. The ventilator according to claim 4, wherein the hub of the impeller wheel in flow direction is embodied to widen conically.

8. The ventilator according to claim 1, further comprising a motor connection box that is integrated on the housing downstream of the motor support.

9. The ventilator according to claim 1, wherein an interface of the motor support can be varied by shaping inserts to be inserted in an injection mold for the housing in that alternatively an interface for an AC motor or an EC motor is selected.

10. The ventilator according to claim 1, wherein an outer area of the inlet nozzle has fastening devices arranged about a circumference of the inlet nozzle.

11. The ventilator according to claim 10, wherein the fastening devices are bores.

12. The ventilator according to claim 1, wherein an outer shape of the inlet nozzle is round, square, or rectangular.

13. The ventilator according to claim 1, wherein the crescent-shaped leading edge is arranged slanted in a direction opposite to a rotational direction of the impeller wheel.

14. A ventilator for use in air-conditioning and refrigeration technology, the ventilator comprising:

a one-part plastic housing comprising:

an inlet nozzle;

a cylinder-shaped flow guiding means adjoining the inlet nozzle;

a diffusor adjoining the cylinder-shaped guiding means at an end of the cylinder-shaped flow guiding means opposite the inlet nozzle;

outlet guide vanes connected to the diffusor at connecting locations;

wherein the inlet nozzle, the cylinder-shaped flow guiding means, the diffusor, and the outlet guide vanes are together monolithically formed of plastic material;

a drive motor arranged in the housing;

an impeller wheel rotatably supported about a central axis in the housing and driven by the drive motor, wherein the outlet guide vanes are arranged downstream of the impeller wheel;

wherein the cylinder-shaped flow guiding means has extensions circumferentially spaced apart and axially extending to the connecting locations of the outlet guide vanes within the diffusor;

a protective screen connected to the housing, wherein the protective screen is positioned downstream of the outlet guide vanes on the housing;

a motor support connected by the outlet guide vanes to the housing;

wherein the impeller wheel has vanes with radially outwardly positioned vane ends, wherein the vane ends are embodied as winglets;

wherein the winglets are spaced at a minimal spacing relative to a sidewall of the housing and said minimal spacing minimizes efficiency losses and noise development;

wherein the drive motor is an external rotor motor that is embodied either an as alternating current asynchronous motor (AC) or an electronically commutated direct current motor (EC);

wherein the outlet guide vanes are curved multi-dimensionally and each have a leading edge and a trailing edge;

wherein the leading edge is crescent-shaped and the trailing edge is serrated or has a wavy shape;

wherein the crescent-shaped leading edge is arranged in a direction opposite to a rotational direction of the impeller wheel.

* * * * *